United States Patent [19]

Paulet

[11] Patent Number: 4,798,656

[45] Date of Patent: Jan. 17, 1989

[54] PROCESS FOR ELECTROLYTICALLY DYEING AN ANODIC OXIDE LAYER ON ALUMINUM OR ALUMINUM ALLOYS

[75] Inventor: Jean-Francois Paulet, Siblingen, Switzerland

[73] Assignee: Swiss Aluminium Ltd., Chippis, Switzerland

[21] Appl. No.: 142,945

[22] Filed: Jan. 12, 1988

[30] Foreign Application Priority Data

Jan. 16, 1987 [CH] Switzerland ..... 145/87

[51] Int. Cl.[4] ..... C25D 5/50

[52] U.S. Cl. ..... 204/37.6; 204/58; 204/228; 204/DIG. 8; 204/DIG. 9

[58] Field of Search ..... 204/37.6, 58, 228, DIG. 9, 204/DIG. 8

[56] References Cited

U.S. PATENT DOCUMENTS

| | | | |
|---|---|---|---|
| Re. 31,901 | 5/1985 | Kawai et al. | 204/28 |
| 3,989,605 | 11/1970 | Yanagida et al. | 204/28 |
| 4,002,549 | 1/1977 | Yanagida et al. | 204/211 |
| 4,043,880 | 8/1977 | Yanagida et al. | 204/37.6 |

*Primary Examiner*—R. L. Andrews

*Attorney, Agent, or Firm*—Bachman & LaPointe

[57] ABSTRACT

In processes for electrolytically dyeing anodic oxide layers on aluminum or aluminum alloys with direct or alternating current in electrolytes containing metal salts, high requirements are imposed on the uniformity of the dyeing and on the dyeing rate. The improvement of the uniformity of the dyeing and an increased dyeing rate can be achieved by pretreating the oxide layer by means of asymmetric alternating current before it is dyed. Such a process is preferably used in combination with an Sn-containing electrolyte.

11 Claims, 1 Drawing Sheet

PROCESS FOR ELECTROLYTICALLY DYEING AN ANODIC OXIDE LAYER ON ALUMINUM OR ALUMINUM ALLOYS

BACKGROUND OF THE INVENTION

The invention relates to a process for electrolytically dyeing an anodic oxide layer on aluminum or aluminum alloys by means of direct or alternating current in an electrolyte containing at least one metal salt.

To electrolytically dye aluminium or aluminium alloys, the latter are first anodically oxidized to form an oxide layer and then subjected, while the pores in the oxide layer are unsealed, to an electrolysis in an electrolyte solution which contains at least one metal salt, for example a nickel salt, in which process, as a result of the electrolytic deposition of metal or metal oxide in the pores of the deposited oxide layer, the latter is superficially dyed.

The dyeing method described is routinely applied and in principle presents no problems provided a markedly uniform dyeing is not required.

Frequently, however, the dyed coatings produced exhibit differences in shade, in particular in the case of the irregularly shaped work pieces which have projecting or recessed areas. A further disadvantage is that the uniformity and the dyeing rate decrease if a prolonged time elapses between the anodic treatment of the metal and the dyeing or if the metal is rinsed too long after anodic treatment has taken place.

To eliminate these disadvantages, a proposal has already been made several times that an anodic direct current treatment of the already anodized metal in the dyeing bath be carried out before the oxide layer is dyed in electrolytes containing metal salts. In this connection, direct current is to be understood to mean virtually similar currents, for example those produced by full-wave rectification of a single-phase alternating current or by rectification of a three-phase alternating current.

The dyeing process used in practice proceeds essentially in a manner such that the aluminum or the aluminum alloy is first anodically oxidized to form an oxide layer and the oxide layer so formed is rinsed off with water. While the pores in said oxide layer are still unsealed, the anodically oxidized metal is immersed together with a counterelectrode in an electrolyte solution. Before the electrolytic superficial dyeing takes place in this solution, a direct current is passed through the solution, the anodically oxidized metal being anodically connected in the solution. Thereafter the metal is subjected to an electrolysis, usually with alternating current, in the same electrolyte, in which process the superficial dyeing takes place.

The invention is based on the object of achieving a better uniformity of the dyeing and an increased dyeing rate in electrolytically dyeing anodic oxide layers on aluminum or aluminum alloys.

SUMMARY OF THE INVENTION

According to the invention, the object set is achieved by a process wherein prior to dyeing of the oxide layer it is pretreated by means of asymmetric alternating current.

After the pretreatment according to the invention with asymmetric alternating current, the dyeing can be carried out by means of direct current, alternating current or asymmetric alternating current.

In electrolytes with corrosive activity in relation to the metal—for example a tin-containing electrolyte at a pH value of 0.6 to 1.2—the dyeing rate has a decisive effect on the corrosion resistance of the anodically produced oxide coating. The oxide layer is partially attacked, particularly for darker shades for which longer dyeing times—up to 10 minutes—are required. Such layers are very susceptible to corrosion in later use and rapidly exhibit unaesthetic blooms on weathering. An important advantage of the process according to the invention is that, in particular if a tin-containing electrolyte is used, such disadvantages do not occur. After all, owing to the resultant high dyeing rate, the dyeing time can be reduced and, consequently, the attack on the oxide layer by the electrolyte is virtually eliminated, which is entirely to the benefit of the corrosion resistance of the dyed layer.

The known phenomenon that, in the electrolytic superficial dyeing of work pieces, a darker shade is usually produced at those parts of the work piece which permit an easier passage of current than at other places where the passages of current cannot take place so easily, as a result of which a uniform dyeing of the work piece surface is not obtained, does not manifest itself in the process according to the invention since the anodically oxidized metal is first subjected to electrolysis with an asymmetric alternating current so that, in the subsequent step in the electrolysis, those places in the oxide layer which permit an easier passage of current are relatively difficult to dye superficially. At the remaining places in the work piece this is not the case. There the passage of current does not take place so easily from the outset. At the same time, the anodically produced oxide layer is perfected with the asymmetric alternating current treatment according to the invention becomes more compact, and this effects an improvement of the barrier action or its semi-conductor properties and, consequently, an increase in the dyeing rate.

BRIEF DESCRIPTION OF THE DRAWINGS

Further advantages, features and details of the invention emerge from the description below of the figures. The types of current as shown diagrammaticaly in FIG. 1 may, for exmple, be used as asymmetric types of alternating current.

Figure 1A:
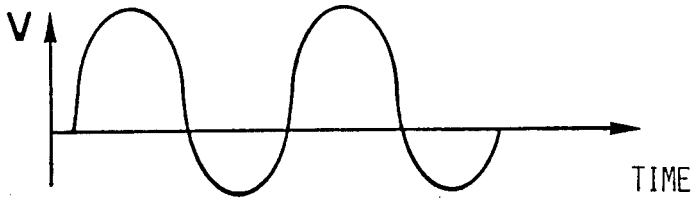
FIG. 1*a* shows a sinusoidal alternating current with a voltage/time curve having unequally high amplitudes in the positive and negative section.
Figure 1B:
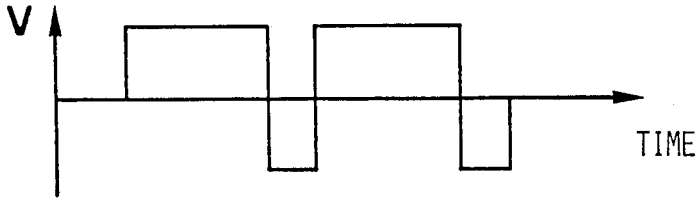
FIG. 1*b* shows a rectangular alternating current with a voltage/time curve having equally high amplitudes and unequally long time components of the positive and negative section.
Figure 1C:
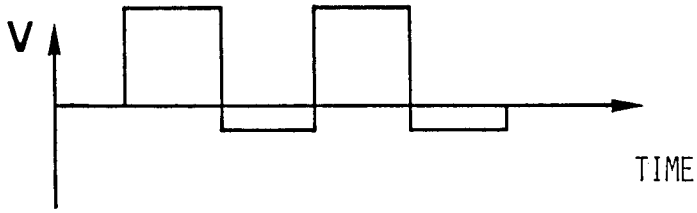
FIG. 1*c* shows a rectangular alternating current with a voltage/time curve having unequally high amplitudes in the positive and negative region.
Figure 1D:
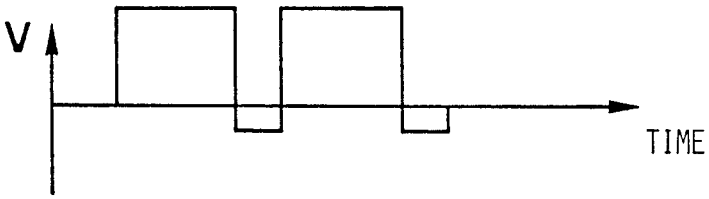
FIG. 1*d* shows in turn a rectangular alternating current with a voltage/time curve having unequally high amplitudes and unequally long time components of the positive and negative section.
Figure 1E:
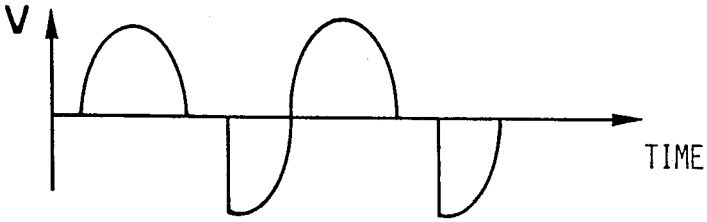
FIGS. 1*e* and 1*f* show sinusoidal alternating current curves with phase gating, in FIG. 1*f* the phase gating being $\frac{3}{4}\pi$ in the positive section and $\frac{1}{4}\pi$ in the negative section.

Other asymmetric alternating currents with interrupted current flow fall, of course, within the scope of the invention.

DETAILED DESCRIPTION

In applying the process according to the invention, to anodically oxidized aluminum or an aluminum alloy, the metal is usually first degreased, rinsed off with water or subjected to another suitable cleaning pretreatment. Thereafter the pretreated metal is anodically connected in the electrolyte solution, which is usually acidic and contains sulphuric acid, oxalic acid, sulpamic acid or the like, after which an electric current is allowed to pass between the metal acting as anode and a cathode immersed as counterelectrode likewise in the solution.

According to the process of the invention, the anodically oxidized metal is subsequently subjected to an electrolysis in a two-stage process, both process steps being carried out in the same electrolyte. The first process step of the electrolysis is carried out according to the invention by passing an asymmetric alternating current through the electrolyte solution in which the anodic oxide layer is anodically connected. In this process a maximum voltage of about 10 to 30 V is employed. The best results were achieved at a voltage of 10 to 20 V. It is advantageous to carry out the first process step no longer than 5 minutes, preferably for a period of 5 to 60 seconds. The second process step is in principle known. It has, however, emerged that, in combination with the first process step according to the invention, a synergy effect occurs in the sense of an appreciable improvement both in the dyeing rate and also in the uniformity of the dyeing if the dyeing is likewise carried out with asymmetric alternating current. Independently of this it has emerged that, in the second process step, a current with a maximum voltage in the range from about 8 to 40 V yields good results, the best results being achieved in the range from 10 to 30 V.

According to the process of to the invention, the anodically produced oxide layer can be very uniformly dyed regardless of the time for which it is rinsed off after it is produced. It was possible to establish that the superficial dyeing proceeds very rapidly if the anodically oxidized metal is treated in the pretreatment operation according to the invention with an asymmetric alternating current voltage which is lower or similar to that which is used for the subsequent dyeing operation.

The invention will be described in further detail with the aid of the following illustrative examples.

EXAMPLE 1

In a first series of experiments consisting of 6 experiments, the depth of color and the uniformity of the dyeing were in each case determined on the basis of reflection measurements: the greater the depth of color, the lower the reflection value R and in the case of measurements at different places of the specimen metal sheet to be dyed, the more uniform the dyeing, the lower the reflection value difference ΔR.

An electrolyte was used which contained 100 g/l $NiSO_4.6H_2O$, 40 g/l boric acid and sulphuric acid and had a pH of 4.0. The bath was contained in a rectangular container with side-lengths of 60 and 130 cm. In the region of the corners and the center of the long sides there were graphite electrodes as counterelectrodes to the aluminum alloy sheet to be dyed at a distance of 6 cm from the wall. The sheet consisted of the alloy AlMgl, had a size of 100×50 cm and was provided with a 20 m anodically (direct current) oxidized layer. The ratio of the area of counterlectrode to sheet to be dyed was 1. The sheet was placed in the center of the container so that all the electrodes were at a uniform distance therefrom. As characteristic current data, the maximum voltages in the positive and negative region, i.e. positive amplitude $V^+$ and negative amplitude $V^-$, and the duration of the current in the positive or negative section measured in milliseconds and denoted as $mS^+$ or $mS^-$ respectively were varied with a constant dyeing time of 2 minutes. The dyeing action was tracked on the basis of reflection measurements with a Unigalvo instrument. The calibration was carried out with standard white, the latter being set at a reflecting power of 80%. The reflection measurements were carried out in the center and in the corner regions situated diagonally opposite each other.

The experimental conditions and results are listed in Table 1. Experiments 1, 3 and 5 have been carried out by dyeing processes known per se using a direct current pretreatment. It was against these that the experiments 2, 4 and 6 carried out using the invention were compared in each case. In the experiments 1 and 2, the dyeing was carried out with sinusoidal alternating current that in experiments 3 and 4 with direct current and that in experiments 5 and 6 with asymmetric rectangular alternating current. Experiment 6 is consequently the special embodiment of the invention wherein the dyeing is carried out with asymmetric alternating current.

The reflection values determined show that, compared with the corresponding comparison experiments, the reflection value difference R is always lower in the experiments using the process according to the invention, which means that, in the experiments carried out according to the invention, a more uniform dyeing of the sheet occurred than in the case of the sheets dyed according to the conventional processes, and the reflection values themselves are always lower, which means that the color intensity or depth of color is stronger in the case of sheets dyed by the process according to the invention than in the case of conventionally dyed sheets. The latter point identifies the process according to the invention as the one with the more rapid dyeing rate.

EXAMPLE 2

In an analogous manner to Example 1, a series of experiments consisting of 7 experiments was carried out, the experimental conditions and results being summarized in Table 2. In this case, an electrolyte was used which contained 15 g/l $SnSO_4$, 20 g/l phenolsulphonic acid, 0.5 g/l β-naphthol and sulphuric acid and had a pH of 1.1 The bath container was the same as in Example 1. The experimental sheets to be dyed consisted of the alloy AlMgl, had a size of 10×25 cm and were provided with a 20 μm anodically (direct current) oxidized layer. Since the Sn-containing electrolyte used itself already has a relatively good throwing power compared with the Ni electrolyte used in Example 1, it was necessary, in order to reveal the advantages of the process according to the invention, to choose an unfavorable anode geometry in these experiments. A graphite counterelectrode used on its own was situated in one corner of the container. Opposite it were disposed the sample sheets at a distance of 8 cm parallel to the longer wall of the container. The ratio of the area of counterelectrode to metal sheet was 0.1. 5 reflection measurements were carried out at uniform spacings over the length of the sheet, the measured value determined in the region of the sheet situated opposite the counterelectrode being designated reflectin value 1 and the measured value determined at the region of the sheet farthest from the counterelectrode being designated reflection value 5. Compared with the samples pretreated with direct current, all the dyed sheets which were pretreated by the processes according to the invention exhibit lower R and ΔR values and lower R mean values. These dyeing results are in agreement with the visual assessment since all the samples had a darker color and exhibited a uniform color distribution without any tintings.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

ing at least one metal salt comprising pretreating the oxide layer prior to dyeing by means of asymmetric alternating current.

2. A process according to claim 1 wherein the oxide layer is pretreated in the same electrolyte in which the subsequent dyeing is carried out.

3. A process according to claim 1 wherein the amplitude of the positive voltage section is 10 to 30 v and/or the amplitude of the negative voltage section is less than or equal to that of the positive voltage section.

4. A process according to claim 1 wherein the amplitude of the positive voltage section is 10 to 20 v and/or the amplitude of the negative voltage section is less than or equal to that of the positive voltage section.

5. A process according to claim 2 wherein the oxide layer is pretreated for a maximum of 5 minutes.

6. A process according to claim 4 wherein the oxide layer is pretreated for a maximum of 5 to 60 seconds.

TABLE 1

| | Pretreatment | | Dyeing | | | Reflection values R (%) | | | | |
|---|---|---|---|---|---|---|---|---|---|---|
| | | | | Alternating current | | | | | | |
| Experiment | Direct current | Assymetric rectangular alternating current | Direct current | sinusoidal | assymetric rectangular | Corner 1 | Centre 2 | Corner 3 | Mean | ΔR |
| 1 | 20 V, 1 Min. | | | 16 V, 2 Min. | | 18.2 | 29.8 | 22.4 | 23.5 | 11.6 |
| 2 | | $mS^+ = 30$ $V^+ = 20$<br>$mS^- = 10$ $V^- = 2$ | | 16 V, 2 Min. | | 14.8 | 22.4 | 16.1 | 17.8 | 7.6 |
| 3 | 20 V, 1 Min. | | 20 V, 2 Min. | | | 19.8 | 24.5 | 20.5 | 21.7 | 4.7 |
| 4 | | $mS^+ = 30$ $V^+ = 20$<br>$mS^- = 10$ $V^- = 2$ | 20 V, 2 Min. | | | 14.1 | 15.5 | 15.1 | 14.9 | 1.4 |
| 5 | 20 V, 1 Min. | | | | $mS^+ = 10$ | 12.9 | 16.2 | 13.5 | 14.2 | 3.3 |
| 6 | | $mS^+ = 90$ $V^+ = 20$<br>$mS^- = 10$ $V^- = 2$ | | | $mS^- = 30$<br>$V^+ = 20$<br>$V^- = 20$<br>2 Min. | 11.2 | 12.4 | 11.3 | 11.6 | 1.2 |

TABLE 2

Figure 1F:
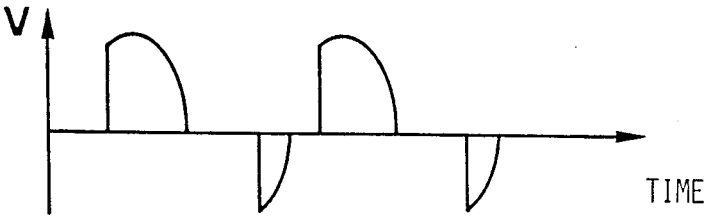

| | Pretreatment | | | Dyeing | |
|---|---|---|---|---|---|
| | | Assymetric alternating current | | Alternating current | |
| Experiment | Direct current | sinusoidal | rectangular | sinusoidal | assymetric rectangular |
| 1 | 18 V, 1 Min. | | | 16 V, 2 Min. | |
| 2 | | | $mS^+ = 30$, $V^+ = 18$<br>$mS^- = 10$, $V^- = 2$ | 16 V, 2 Min. | |
| 3 | 18 V, 1 Min. | | | | $mS^+ = 10$ |
| 4 | | | $mS^+ = 30$, $V^+ = 18$<br>$mS^- = 10$, $V^- = 2$ | | $mS^- = 30$<br>$V^+ = 18$ |
| 5 | | | $mS^+ = 40$, $V^+ = 18$<br>$mS^- = 10$, $V^- = 18$ | | $V^- = 18$<br>2 Min. |
| 6 | | as FIG. 1a<br>$V^+ = 18$<br>$V^- = 10$<br>50 Hz | | | |
| 7 | | as FIG. 1f with phase gating<br>$V^+ = V^- = 18$<br>$\frac{3}{4}\pi^+, \frac{1}{4}\pi^-$ | | | |

| | Reflection value | | | | | | |
|---|---|---|---|---|---|---|---|
| Experiment | Anode side 1 | 2 | 3 | Centre 4 | side remote from anode 5 | Mean | ΔR |
| 1 | 13.4 | 22.3 | 24.8 | 25.4 | 25.7 | 23.3 | 12.3 |
| 2 | 12 | 19 | 19.2 | 20.5 | 21 | 18.3 | 9 |
| 3 | 10.9 | 11.2 | 12.5 | 13.6 | 14.2 | 12.5 | 3.3 |
| 4 | 7.2 | 7.5 | 7.9 | 8.1 | 8.3 | 7.8 | 1.1 |
| 5 | 7.5 | 7.6 | 7.8 | 8.2 | 8.5 | 7.9 | 1 |
| 6 | 7.9 | 8.1 | 8.1 | 8.5 | 9.1 | 8.3 | 1.2 |
| 7 | 11.1 | 12.0 | 12.0 | 12.1 | 13.2 | 12.1 | 2.1 |

I claim:

1. A process for electrolytically dyeing an anodic oxide layer on aluminum or aluminum alloys by means of direct or alternating current in an electrolyte containing at least one metal salt comprising pretreating the oxide layer prior to dyeing by means of asymmetric alternating current.

7. A process according to claim 1 wherein the dyeing is carried out with direct current.

8. A process according to claim 1 wherein the dyeing is carried out with alternating current.

9. A process according to claim 1 wherein the dyeing is carried out at a maximum voltage of about 8 to 40 V.

10. A process according to claim 1 wherein the dyeing is carried out at a maximum voltage of about 10 to 30 V.

11. A process according to claim 1 wherein a tin-containing electrolyte is used.

* * * * *

UNITED STATES PATENT AND TRADEMARK OFFICE

CERTIFICATE OF CORRECTION

PATENT NO. : 4,798,656

DATED : January 17, 1989

INVENTOR(S) : Jean-Francois Paulet

It is certified that error appears in the above-identified patent and that said Letters Patent is hereby corrected as shown below:

Column 6, Claim 5, line 15, "claim 2" should read -- claim 3 --.

Signed and Sealed this

Twentieth Day of June, 1989

*Attest:*

DONALD J. QUIGG

*Attesting Officer*

*Commissioner of Patents and Trademarks*